United States Patent [19]

Zimmerman, Jr.

[11] 4,200,350

[45] Apr. 29, 1980

[54] TOOLLESS RETENTION SYSTEM

[75] Inventor: John A. Zimmerman, Jr., Hershey, Pa.

[73] Assignee: AMP Incorporated, Harrisburg, Pa.

[21] Appl. No.: 888,443

[22] Filed: Mar. 20, 1978

[51] Int. Cl.[2] ..... H01R 13/54

[52] U.S. Cl. ..... 339/91 R; 339/210 M

[58] Field of Search ..... 339/206 R, 206 P, 206 L, 339/207 R, 207 S, 210 R, 210 M, 210 T, 101, 102 R, 91 R, 74 R, 75 R

[56] References Cited

U.S. PATENT DOCUMENTS

| | | | |
|---|---|---|---|
| 3,395,244 | 7/1968 | Koehler | 339/101 |
| 3,842,388 | 10/1974 | Harwood | 339/91 R X |
| 3,950,052 | 4/1976 | Walter | 339/101 X |
| 4,037,906 | 7/1977 | Jayne | 339/206 R X |

FOREIGN PATENT DOCUMENTS

| | | | |
|---|---|---|---|
| 1315693 | 5/1973 | United Kingdom | 339/59 M |

*Primary Examiner*—Joseph H. McGlynn
*Assistant Examiner*—John S. Brown
*Attorney, Agent, or Firm*—Russell J. Egan

[57] ABSTRACT

An improved electrical connector is disclosed having means included therein providing contact retention and release without requiring the use of special or additional tools. The subject connector has a closed entry feature for sockets and functions cooperatively with a flexure guard, strain relief and/or coupling apparatus.

9 Claims, 5 Drawing Figures

TOOLLESS RETENTION SYSTEM

BACKGROUND OF THE INVENTION

1. The Field Of The Invention

The present invention relates to an electrical connector and in particular to an electrical connector having a contact retention and release means which obviates the needs for special tooling.

2. The Prior Art

Toolless retention systems for holding electrical contacts in connector housings have been well known in the electrical connector industry. These types of known connectors generally fall into these categories. The first category is a completely flexible connector housing which bends to allow insertion and removal of the terminals and in a released, normal position substantially encloses the terminals. Examples of this type of connector can be found in U.S. Pat. Nos. 2,332,846, 3,188,604, and 3,582,863. A second type of connector housing is the type having a cover or other moveable member hingedly connected to a rigid connector housing and moveable from a displaced position, allowing entry and withdrawal of the terminal, to a normal condition, in which the withdrawal of the terminal is prohibited. Examples of such connectors can be found in U.S. Pat. Nos. 3,693,134, 3,789,344, and 3,842,388. Another type of electrical connector, which substantially obviates the need for tools, has pieces of the connector housing which are displaceably mounted on the housing. Examples of this can be found in U.S. Pat. No. 3,697,933, in which pieces are specifically positioned in the housing to restrain movement of the terminals, and U.S. Pat. No. 4,025,151, where a piece of the housing is initially molded as an integral portion and then is separated and relocated to form a barrier to the terminals.

SUMMARY OF THE INVENTION

The present invention concerns an electrical connector in which the terminals are retained and released without requiring special tools. The connector includes a housing member defining an elongated cavity and an elongated terminal carrying insert member which is received in the cavity. The insert member has a plurality of terminal passages therein extending between a mating front face and a spaced, oppositely directed rear face. At least one hinged portion having an L-shaped longitudinal section extends rearwardly from an intermediate point on a side of the insert member. In a normal open condition the hinged portion allows terminals to be freely inserted into and withdrawn from respective passages in the insert member. Simple finger pressure closes the hinged portions to mate with the rear face thereby retaining the terminals therein and allowing insertion of the terminal carrying insert member into the elongated cavity of the housing member, where the hinged portions are held in a closed position and latchingly engage with the housing member prohibiting unintended withdrawal of the insert member therefrom.

It is therefore an object of the present invention to produce an improved electrical connector in which the terminals are retained therein and released therefrom without the use of special tools.

It is a further object of the present invention to produce an improved electrical connector in which an insert member carries a plurality of terminals and has at least one integral hinged portion which, in a closed condition, holds the terminals within the insert member and the insert member in a connector housing.

It is a further object of the present invention to produce an improved electrical connector which can be readily and economically produced.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
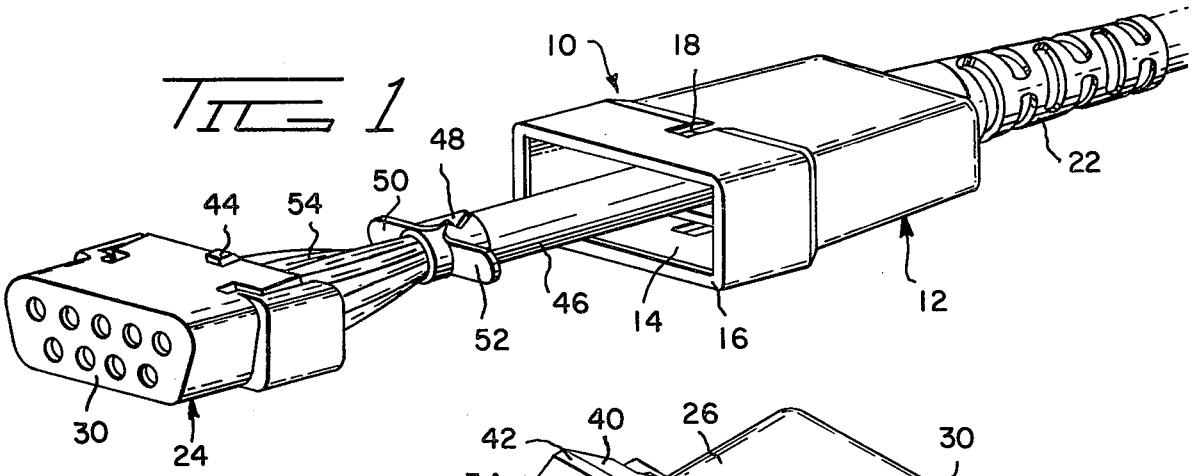
FIG. 1 is an exploded perspective view of an electrical connector according to the present invention.

The subject electrical connector 10 includes a housing 12 of rigid insulation material defining an elongated cavity 14 opening onto a mating face 16. At least one latching aperture 18 is positioned in the housing spaced from the mating face 16. The cavity 14 also has an inwardly directed annular shoulder 20 spaced from the mating face. An integral cord flexure guard 22 extends from the rear of the housing 12. A terminal carrying insert member 24 is profiled for receipt into the cavity 14. The insert member has a body 26 with a plurality of terminal passages 28 extending therethrough from a mating front face 30 to a rear face 32. At least one hinged cover portion 34 is integrally attached to body 26 intermediate the faces thereof and extending in a rearward direction. The hinged cover portion has an L-shaped section with the free end of the shorter leg 36 in a closed condition, forming part of the rear face of the insert member. The free edge of leg 36 is profiled with recesses 38 to allow passage of conductors therethrough. The outside juncture of the legs 36, 40 is bevelled at 42 to form a cam surface. A latching lug 44 integrally projects from leg 40 positioned for engaging with aperture 18 of housing 12.

Figure 3:
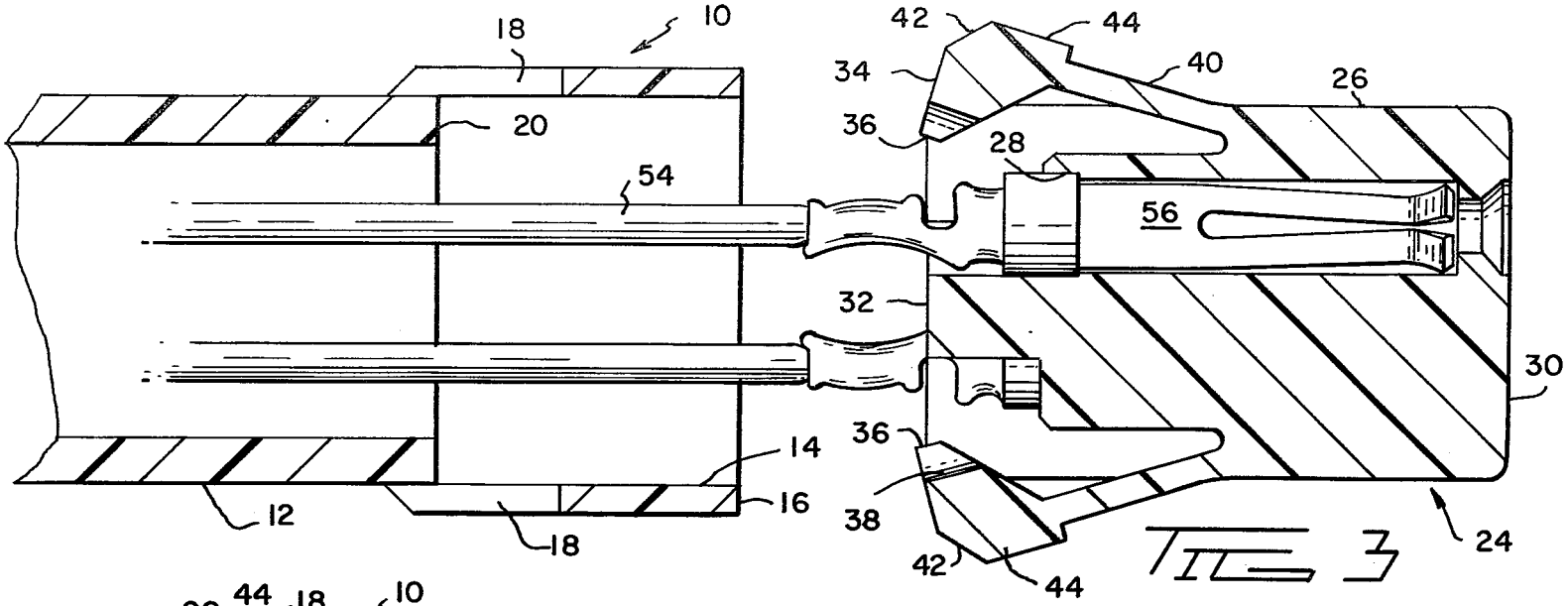
FIG. 3 is a longitudinal vertical section through the connector of FIG. 1.
Figure 4:
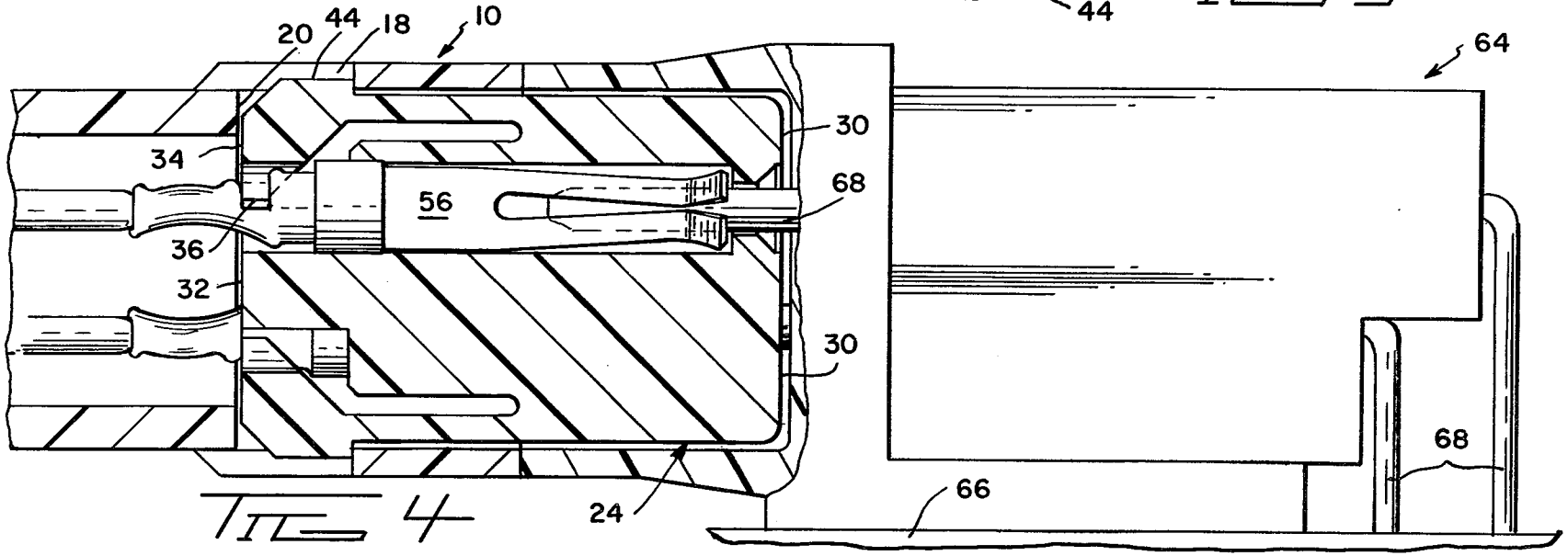
FIG. 4 is a side elevation, partially in section, of the subject connected mated with a receptacle.

The subject connector is assembled by passing the free ends of cable 46 through guard 22 and cavity 14 of housing 12. A known strain relief 48 having ears 50, 52 is crimped onto the cable behind the point where the insulating jacket has been removed from the individual conductors. The individual conductors 54 of the cable are terminated with conventional terminals, such as the socket terminals 56 shown in FIGS. 3 and 4. The terminals 56 are freely inserted into respective terminal cavities 28. The hinged cover portions 34 are then manually depressed, simple finger pressure is sufficient, until the terminals are retained therein by leg 36. The loaded insert member 24 is moved rearwardly into the cavity 14 until the lugs 44 engage in the latching apertures 18. During the insertion, the surfaces 42 will engage the housing and hold the hinged portions in their closed condition. The insert member 24 will bottom against shoulder 20 to prevent being driven in to the housing too far. Thus the terminals 56 are securely held in the insert member 24 and the insert member in turn is held in the housing and will withstand many matings and unmatings of the connector without becoming disassembled. To remove the insert member 24 and/or any of the terminals 56, it is simply a matter of applying pressure to the hinged portions 34 to depress them sufficiently to free the lugs 44 from the respective apertures 18 and to withdraw the insert member. The terminals 56 can then be removed simply by opening the hinged portion 34 and pulling the terminal out.

Figure 5:
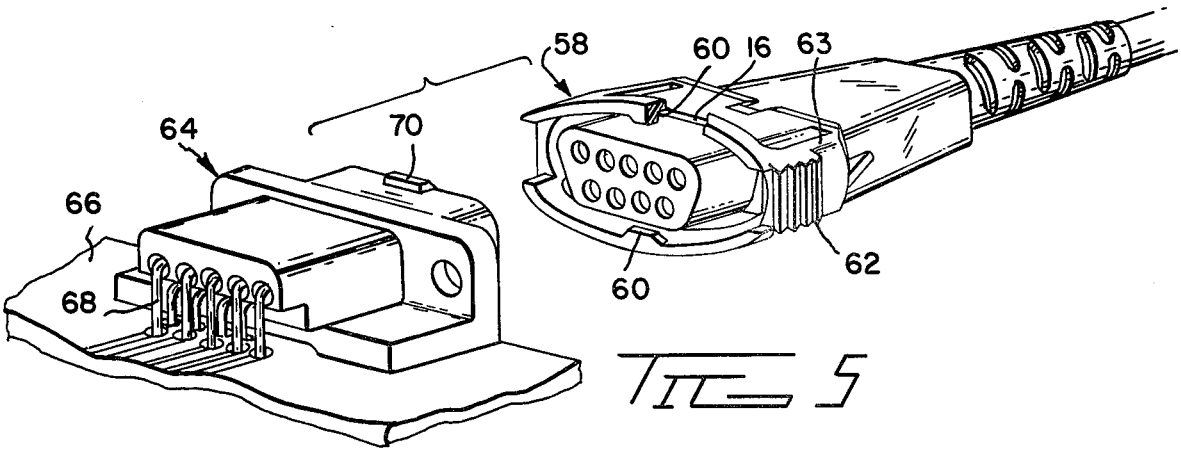
FIG. 5 is an exploded perspective of an alternate embodiment of an electrical connector according to the present invention and an associated receptacle.

An alternate embodiment of the invention is shown in FIG. 5 with a squeeze-to-release coupling 58 formed extending forwardly of the mating face 16 of the housing 12. This coupling 58 has a generally oval shape with a pair of opposed inwardly directed lugs 60 on the elongated sides, a pair of gripping portions 62 on opposite end surfaces thereof and a pair of webs 63 attaching the coupling 58 to housing 12. A typical receptacle 64 is shown mounted on the edge of a printed circuit board 66 with the terminals 68 thereof in engagement with the board. The receptacle is provided with outwardly directed lugs 70 which will engage with the squeeze-to-release coupling to secure the plug portion to the receptacle.

While it is clear that the present invention has been shown with a plug type connector that is carrying receptacle type contacts therein, it should be noted that it is well within the perview of the invention to have a reversal part to form a socket type connector with male or pin type terminals therein and still incorporate the principal features of the present invention.

Figure 2:
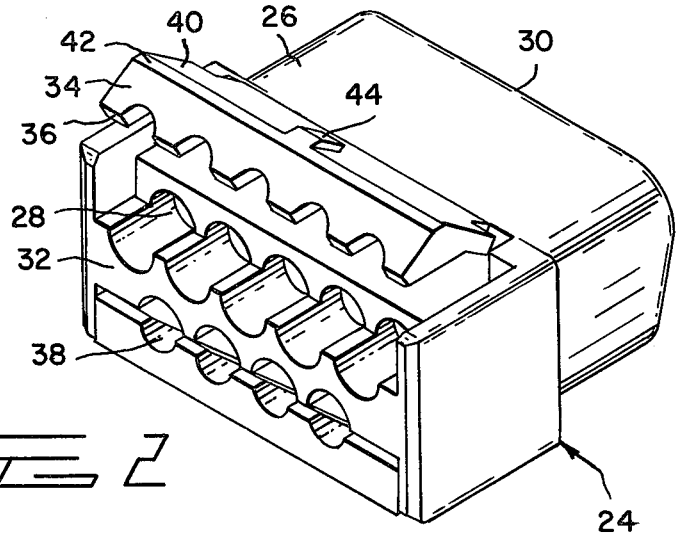
FIG. 2 is a rear perspective of the insert member of the present invention.

The insert member is shown in FIG. 2 with one hinged portion closed and another partially opened. It should be noted that there is no criticality in the open angle for molding the hinged portions. They, of course, could be molded at a first angle and further opened to a second angle for loading the terminals.

The present invention may be subject to many modifications and changes without departing from the spirit or essential characteristics of the invention. The present embodiment should be considered in all respects as illustrative and not restrictive of the scope of the invention.

What is claimed is:

1. An improved electrical connector providing toolless retention and release of electrical terminals carried thereby, said connector comprising:

a housing of rigid insulative material defining therein a forwardly opening cavity, at least one aperture in a sidewall of said housing spaced from said opening of said cavity; and a terminal carrying insert member having a plurality of terminal carrying passages extending therethrough from a mating face to a rear face, at least one cover, each said cover being hingedly attached by one end to said insert member intermediate the faces thereof and having an inwardly directed abutment on the opposite free end, each said cover being moveable between a first position with the abutment on said free end substantially blocking the rear of said terminal passages and preventing withdrawal of terminals contained therein to a second normal position in which said abutment free of said passages, and an outwardly directed lug on said cover portion, whereby terminals inserted into said passages are held therein by closure of said at least one cover portion and said insert member is held in the cavity of said housing by engagement of each said lug in a respective aperture.

2. The electrical connector according to claim 1 further comprising a flexure guard extending from a rear portion of said connector housing.

3. An electrical connector according to claim 1 further comprising a generally oval shaped squeeze-to-release coupling extending forwardly of and surrounding the opening of said cavity in the housing, a pair of opposed inwardly directed lugs on the elongated sides of said coupling and outwardly directed gripping portions on the opposite ends thereof whereby squeezing said gripping portions of said coupling deforms it sufficiently from said oval shape for said lugs to clear cooperating portions of a mating member.

4. The electrical connector according to claim 1 further comprising an inwardly directed shoulder within said cavity spaced from the opening thereof preventing too deep penetration of said cavity by said insert member.

5. The electrical connector according to claim 1 wherein said housing, said cavity and said insert member have an elongated transverse profile.

6. The electrical connector according to claim 1 wherein said at least one cover comprises a pair of covers each hingedly attached to respective sides of said insert member and acting in clam shell fashion to form an abutment for said terminals in the closed condition.

7. The electrical connector according to claim 6 further comprising an outwardly directed cam surface on said cover portion at the juncture of said arms whereby said cover portion is cammed to a closed condition during insertion into said cavity of said housing.

8. The electrical connector according to claim 6 further comprising an inwardly directed cam surface on said cover portion at the juncture of said arms whereby closing of said cover portion seats a terminal in a respective passage.

9. An improved electrical connector providing toolless retention and release of electrical terminals carried thereby, said connector comprising:

an elongated housing of rigid insulative material defining therein a forwardly opening cavity of like profile, an aperture in each long sidewall of said housing spaced from the opening to said cavity, an inwardly directed shoulder in said cavity spaced from said opening, and a flexure guard communicating with said cavity and extending from a rear portion of said housing;

an elongated terminal carrying insert member receivable in said cavity, said member having a plurality of terminal carrying passages extending therethrough from a mating face to a rear face, a pair of L-shaped covers each hingedly attached to a respective long side of said insert member, said cover portions being moveable in clam shell fashion between a first position in which the short side substantially blocks the rear of said terminal passages forming an abutment for said terminals and a second position free of said passages, and an outwardly directed lugs on said cover portion aligned to engage said apertures in said cover, a plurality of terminals each having one end secured to a conductor of a cable and a mating end lying in a respective passage; and strain relief means secured to said cable and lying within said housing, whereby terminals inserted into said passages are held therein by closure of said cover members and said insert member is held in said housing by engagement of said lugs in said apertures.

* * * * *